US005168825A

United States Patent [19]

Ring

[11] Patent Number: 5,168,825

[45] Date of Patent: Dec. 8, 1992

[54] REVERSIBLE CANOE AND CAMP SEAT

[76] Inventor: Mark Ring, 15520 Oric Ave., Minnetonka, Minn. 55343

[21] Appl. No.: 850,404

[22] Filed: Mar. 11, 1992

[51] Int. Cl.[5] ..... B63B 17/00

[52] U.S. Cl. ..... 114/363

[58] Field of Search ..... 114/345, 347, 363, 364

[56] References Cited

U.S. PATENT DOCUMENTS

| | | | |
|---|---|---|---|
| 1,387,957 | 8/1921 | Zeidler et al. | 114/363 |
| 2,299,178 | 2/1941 | Reiter | 114/363 |
| 2,671,231 | 6/1951 | Massicotte | 114/347 |
| 2,815,517 | 11/1954 | Andresen, Jr. | 114/364 |
| 3,328,811 | 10/1965 | Norton | 114/363 |
| 3,718,365 | 2/1973 | Gibson | 114/363 |
| 3,795,927 | 3/1974 | Darwin | 114/363 |
| 3,958,289 | 5/1976 | Carlson | 114/364 |
| 4,380,208 | 4/1983 | Goserud | 114/364 |
| 4,493,285 | 1/1985 | Williams | 114/363 |
| 4,672,911 | 6/1987 | Hodgins | 114/363 |
| 4,768,459 | 9/1988 | Cerkvenik et al. | 114/363 |

*Primary Examiner*—Jesûs D. Sotelo

*Attorney, Agent, or Firm*—Joseph F. Breimayer

[57] ABSTRACT

A portable, adjustable seat for suspension between the gunwales of a canoe, when used in a first orientation as a canoe seat, of a rigid construction that permits its use in a second, reverse orientation as a camp stool, when camping. The seat comprises a pair of cross members spaced from one another by a pair of braces to form a generally rectangular platform, a fabric sheet extending from one cross member to the other within the rectangular platform to provide a seating area, and left and right pairs of legs shaped to attach to the left and right ends of the pair of cross members (in the gunwales of the canoe) to suspend the seating area below and within the gunwales in the first orientation and to act as stool legs in the second orientation, the entire construction being sufficiently rigid to support the weight of a person when used in either orientation. Preferably the fitting of the legs with the right and left ends of the pair of cross members may be independently adjusted and locked to accommodate differing canoe gunwale widths or the change in width along the length of a given canoe, while maintaining rigidity and support.

3 Claims, 2 Drawing Sheets

REVERSIBLE CANOE AND CAMP SEAT

BACKGROUND OF THE INVENTION

1. Field of the Invention

The present invention relates to a seat for use in recreational boating and camping and, in particular, to a reversible seat assembly mountable for suspension between the gunwales of a canoe to act as a seat in a first orientation and removable from the canoe to act as a camp stool in a second reverse orientation.

2. Description of the Prior Art

Over the years, recreational canoeists have devised many ways in which to accommodate additional passengers or paddlers in the "duffers" position generally in the center of the canoe adjacent to where the canoe yoke is normally positioned across the gunwales of the canoe. Canoes designed for camping are normally provided with a carrying yoke extending between the gunwales which the canoeist employs when portaging the canoe from one water course to another. Consequently, fixed seats which would interfere with the carrying yoke are not built into such recreational canoes. Consequently, it is necessary when accommodating a passenger in a standard camping canoe to jerry-rig a seating platform off the wet and uncomfortable canoe floor from available camping packs, life jackets and the like, or to temporarily suspend a seat across the gunwales of the canoe. The prior art contains a number of approaches to solving the problem of accommodating a passenger or for setting up the canoe to be rowed with oars.

U.S. Pat. No. 4,768,459 describes the difficulties and discomforts of conventional carrying yokes. In the 459 patent, an assembly is described which operates in one position as a seat and in a reverse or inverted position as a carrying yoke where the seat elements are a pair of flexible support pads which support the canoe s weight on the canoeist's shoulders and act as shock absorbers during portaging. When positioned as a canoe seat, the support pads are suspended below and between the gunwales, and when reversed and repositioned as a yoke, the pads are positioned above the gunwales a distance to accommodate the canoeist's head between the gunwales.

A number of other canoe seats have been proposed for suspension between the gunwales of a canoe, including those described in U.S. Pat. Nos. 1,387,957, 2,299,278, 3,958,289, and 3,328,811. The '811 patent employs a rigid seat that is suspended by a pair of hooks between the gunwales where the hooks are pivotable to accommodate varying boat widths in a self-adjusting manner. When not in use, the hooks fold onto the platform for storage. The '178 patent also discloses a rigid platform having a width adjustment to accommodate either differing width boats or to allow positioning along the varying width boat length.

A further portable canoe seat is disclosed in U.S. Pat. No. 4,380,208 which employs flexible rope suspension members for supporting a flexible sheet seat between the gunwales of a canoe or boat. The nonrigid structure allows it to be readily removed and rolled up when not in use.

Finally, various systems have been devised to allow a canoe to be rowed, with or without supporting outriggers, such as the canoe seats and oar lock units described in U.S. Pat. Nos. 2,815,517 and 4,672,911. The combination canoe seats and oar lock units have arms extending outward of the gunwales to support oar locks.

The prior art thus discloses a number of approaches to providing additional seating along the length of a canoe or boat having various advantages and features. I have found that a need remains for a simple and inexpensive rigid canoe and camping seat that may be easily adjusted to accommodate canoes of varying widths or to be moved along the length of the canoe body to facilitate loading camping supplies or to allow one person paddling of a two-person canoe, where the adjustment may be readily accomplished without the use of tools or modification of the canoe's factory construction and the adjusted seat may be easily slipped over and removed from the gunwales of the canoe.

I have also found it desirable to have on hand a portable camp stool to provide dry, comfortable seating in camp. None of the prior art removable canoe seats designed to be temporarily attached to the gunwales of the canoe may be used for seating apart from the canoe itself.

SUMMARY OF THE INVENTION

Accordingly, it is the primary object of the present invention to provide a reversible, portable canoe seat and camp stool which may be used in a first orientation as a temporary, rigid canoe seat and in a second, reverse orientation, is a rigid camp stool.

In one construction, the invention takes the form of a reversible, adjustable seat for suspension between the gunwales of a canoe, when used in a first orientation as a canoe seat, of a rigid construction that permits its use in a second, reverse orientation as a camp stool, when camping. Preferably, the seat comprises a pair of cross members spaced from one another by a pair of braces to form a generally rectangular platform, a fabric sheet extending from one cross member to the other within the rectangular platform to provide a seating area, and left and right pairs of legs shaped to attach to the left and right ends of the pair of cross members (in the gunwales of the canoe) to suspend the seating area below and within the gunwales in the first orientation and to act as stool legs in the second orientation, the entire construction being sufficiently rigid to support the weight of a person when used in either orientation. Preferably the fitting of the legs with the right and left ends of the pair of cross members may be independently adjusted and locked to accommodate differing canoe gunwale widths or the change in width along the length of a given canoe, while maintaining rigidity and support.

In a preferred embodiment, the rectangular platform is a lightweight rigid tubular frame of the pair of cross members and the pair of braces, and the left and right ends of the tubular cross members are configured to receive the first ends of each of the legs with adjustable locking members for fixing the first ends of the legs at predetermined points within the ends of the cross members to provide independent adjustment of the overall width of the seat assembly to accommodate the change in gunwale width along its length. The first ends of the legs comprise a straight length of tubular material configured to fit within the left and right ends of the pair of cross members. At a certain point along the length of each leg, it is turned at about 90 degrees and the remainder of each leg is formed in a "J" or "L" shape so that the other end of the leg fits over and rests upon the gunwales of the canoe.

The first ends of the legs are adjusted to fit the width of the canoe between its gunwales at the location along the length of the canoe where it is desired to position the seat. When the adjustment is made and the legs are locked in place, the seat simply rests between the gunwales and is not attached to the canoe. Consequently, when portaging or making camp, the seat may be lifted out of the canoe and either carried or used in its locked, fully adjusted position as a camp stool simply by flipping it over and placing the J-shaped or L-shaped ends of the legs on the ground. For portaging, the seat may be attached to a backpack or disassembled and packed.

BRIEF DESCRIPTION OF THE DRAWINGS

The above objects, advantages and distinctions, as well as the construction of the present invention, will become more apparent upon directing attention to the following description which is made relative to the appended drawings in which.

DESCRIPTION OF THE PREFERRED EMBODIMENT

Figure 1:
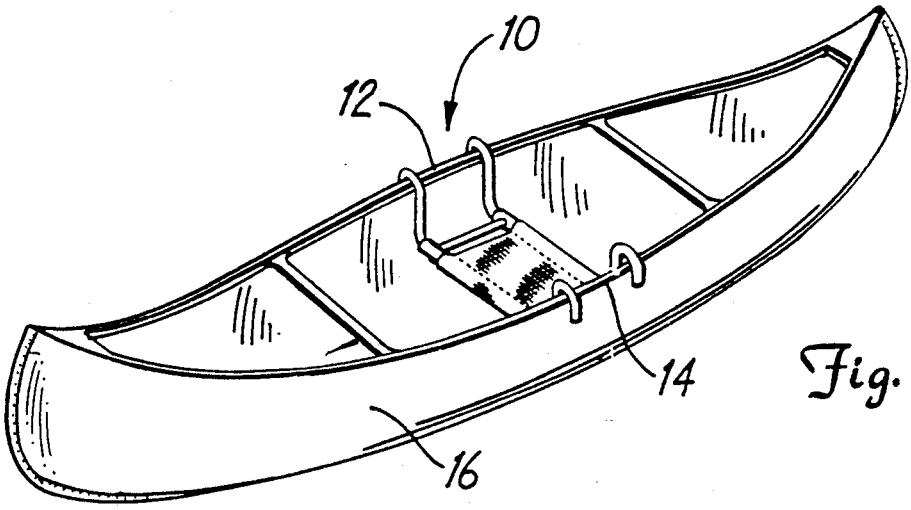
FIG. 1 shows a perspective view of a canoe with the combination seat/camp stool suspended from the canoe gunwales in its first, seat orientation.

Referring now to FIG. 1, a perspective is shown of the present seat/camp stool 10 suspended from the right and left canoe gunwales 12 and 14 of a typical canoe 16. The seat/camp stool 10 is positioned generally centrally of the canoe 16 and adjacent to the fixed carrying yoke (not depicted).

Figure 2:
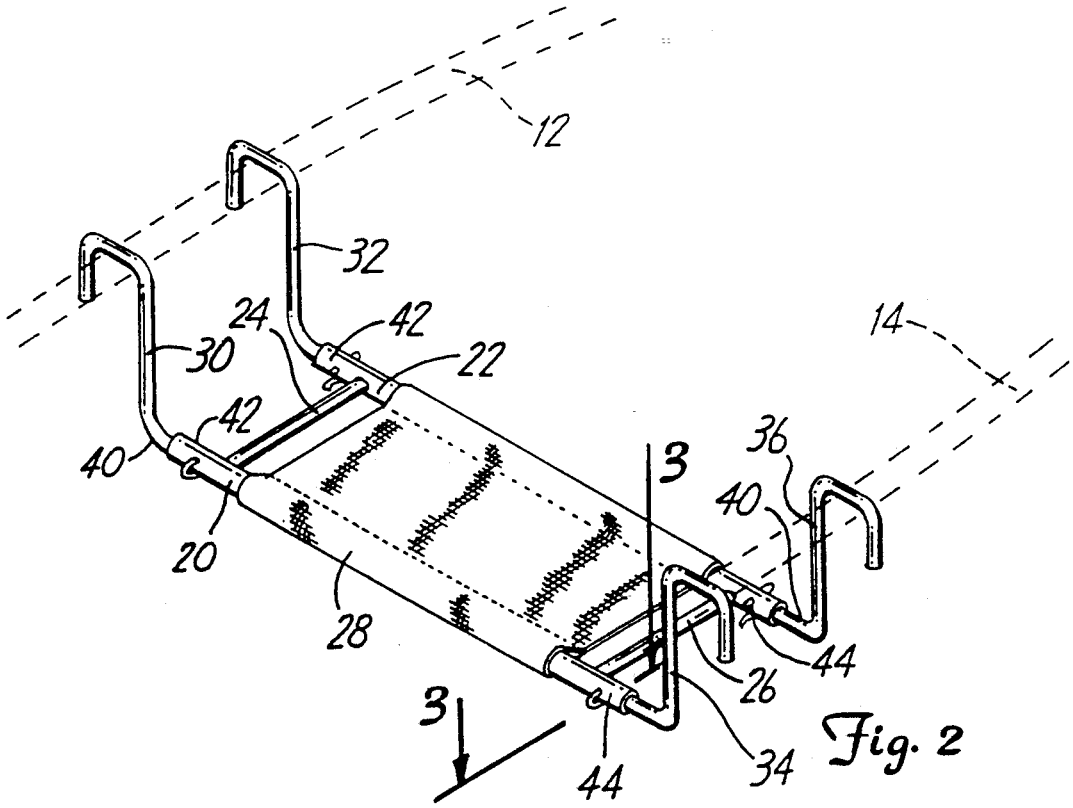
FIG. 2 is a perspective view of the assembled seat/-camp stool of FIG. 1.

Referring now to FIG. 2, the seat/stool 10 comprises first and second cross members 20 and 22 which are rigidly attached to one another by first and second braces 24 and 26 to form a generally rectangular platform over which a sheet of material forming a seat 28 is fitted. The sheet 28 may comprise ripstock nylon or canvas or a relatively open netting material formed in a continuous loop extending around the cross members 20 and 22. Although not specifically illustrated, it will be understood that the seat 28 may be made of a canvas sheet having eyelets and removable laces along two opposite sides of the sheet so that it can be stretched around the cross members 20 and 22 and laced tightly to draw the opposite sides toward one another.

To support the seat, right and left pairs of J-shaped (or L-shaped) legs 30, 32 and 34, 36 extend from the right and left ends 42 and 44 of the cross members 20, 22 toward the gunwales of the canoe. Each of the legs 30, 32, 34, 36 is shaped to extend in a J-shape (or L-shape) upward and over the tops of the canoe gunwales 12 and 14 as shown in FIGS. 1 and 2 and to have a straight portion or first end 40.

The rigid rectangular platform of the seat 10 is preferably formed of tubular aluminum stock cross members 20, 22 and braces 24, 26. The braces 24, 26 are attached by fittings or other conventional means to the cross members 20, 22 in such a way as to avoid obstructing or encroaching into the inside opening of the cross members 20, 22 so as to allow the first ends 40 of each of the legs 30, 32, 34, 36 to be slidably fitted within the right and left ends 42, 44 of the cross members 20, 22 so that the distance between the fore and aft sets of right and left legs 30, 32 and 34, 36 may be independently adjusted.

Figure 3:
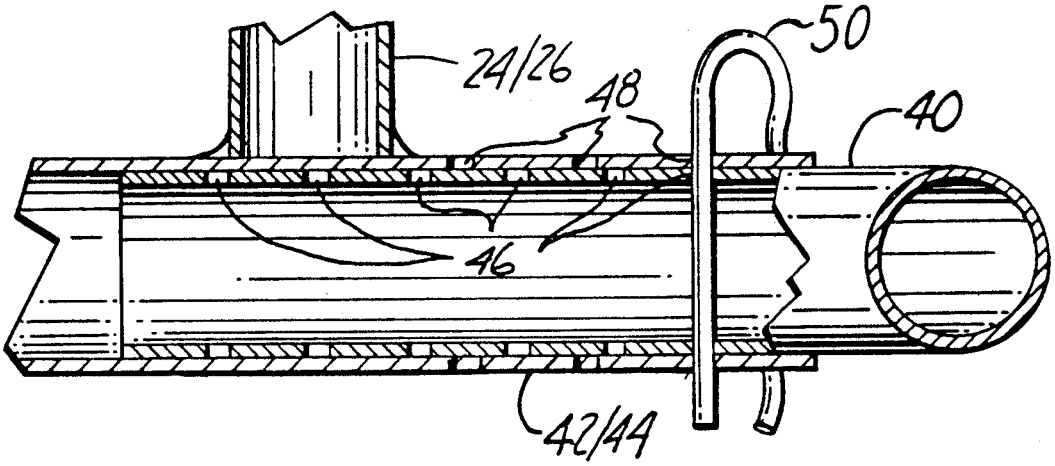
FIG. 3 is a partial cross-section of the first end of a leg in relation to a cross member end and the adjustable lock mechanism for adjusting the width of the seat assembly.

Turning now to FIG. 3, it depicts in partial cross section the adjustment mechanism for rigidly attaching the first ends 40 of the legs to the right and left ends 42 and 44 of the cross members as described above. In FIG. 3, the end 40 is shown fitted inside the end 42 or 44 of the tubular cross members 20 or 22. The end 40 of each leg is provided with a series of holes 46 drilled through it which may be aligned with one of a series of holes 48 in the end 42 or 44. Once aligned, a spring and clip 50 is slipped through the aligned holes to lock each leg end 40 to each cross member end 42 or 44. In this fashion, each of the legs 30, 32, 34, 36 may be separately adjusted to fit the seat in a desired position within a given canoe.

Figure 4:
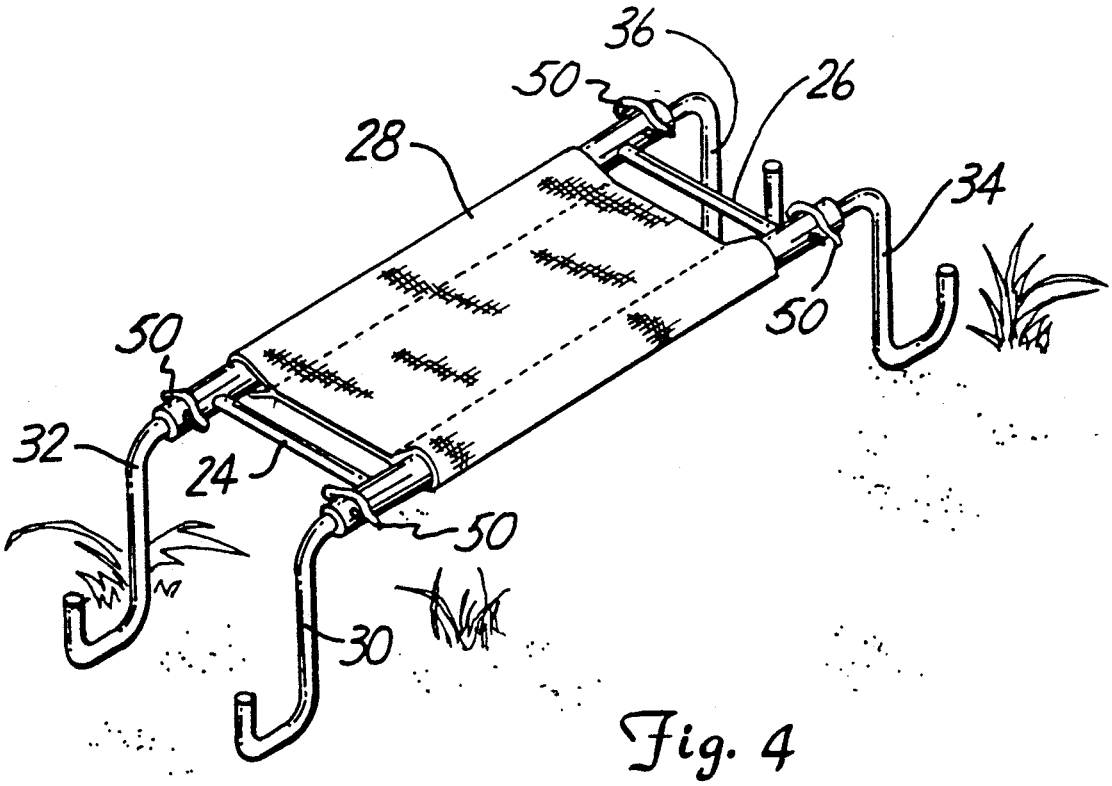
FIG. 4 is a perspective view of the seat/stool placed in its second, reverse position as a camp stool.

The particular locking assembly that is employed may be varied so long as the resulting locked assembly is sufficiently rigid that the seat may be reversed as shown in FIG. 4 and employed as a camp seat.

For example, although not shown in the drawings, it will be understood that the straight portions or first ends 40 of the legs 30, 32, 34, 36 and the bores in the ends 42 and 44 of the cross members 20 and 22 may be squared or shaped in other than a circular shape so that the legs can be inserted in the two seat orientations and will not collapse when inserted to support the seat in the reverse, camp seat orientation illustrated in FIG. 4, even if the clips 50 are not used or are lost.

Preferably the seat frame is filled with flotation foam in the area of seat 28 and in the J-shaped or L-shaped portions of the legs. In addition, the clips 50 may be attached to the seat frame or legs by lengths of cable or the like to avoid their loss.

However, even if the clips 50 are not available, the slidable legs 40, in the right and left ends 42 and 44 of the cross members 20 and 22, will still support the seat and automatically align it across the gunwales 12 and 14 of a canoe or other boat.

While there has been shown what are considered to be the preferred embodiments of the invention, it will be manifest that many changes and modifications may be made therein without departing from the essential spirit of the invention. It is intended, therefore, in the following claims to cover all such changes and modifications as may fall within the true scope of the invention.

What is claimed is:

1. A portable, reversible boat and camp seat comprising:

seat platform means comprising a generally rectangular rigid frame with a flexible sheet material stretched across the frame for supporting a seated person; and a plurality of rigid leg means having generally horizontal and vertical extending portions for suspending the seat platform means between and below the gunwales of a boat in a first orientation and for supporting the seat platform means above the ground in a second, reverse orientation; and wherein said platform means further comprises means for receiving the generally horizontal extending portions of the plurality of leg means at the corners of the generally rectangular rigid frame and extending the generally vertical portions of the leg means at generally right angles to said platform means.

2. The seat of claim 1 wherein said receiving means further comprises means for positioning the generally vertical portions of the leg means at differing spaced positions laterally from the platform to accommodate changes in width of the gunwales of the boat along its length or different width boats.

3. The seat of claim 2 wherein said positioning means further comprises means for locking each of the leg means in said spaced positions.

* * * * *